United States Patent [19]

Fleming et al.

[11] 4,068,874

[45] Jan. 17, 1978

[54] ROTARY LATCH MECHANISM WITH LOCKING DEVICE

[75] Inventors: Paul D. Fleming; Kenneth N. Gullekson, both of Glendale, Calif.

[73] Assignee: W & F Manufacturing Inc., Glendale, Calif.

[21] Appl. No.: 662,623

[22] Filed: Mar. 1, 1976

[51] Int. Cl.[2] ..... E05C 3/04; E05C 19/10

[52] U.S. Cl. ..... 292/128; 70/96; 292/359; 292/DIG. 46

[58] Field of Search ..... 292/128, 228, 226, DIG. 24, 292/DIG. 46, 359; 70/95, 96, DIG. 19

[56] References Cited

U.S. PATENT DOCUMENTS

| | | | |
|---|---|---|---|
| 1,760,394 | 5/1930 | Best et al. | 292/359 |
| 2,233,353 | 2/1941 | Meer et al. | 292/359 |
| 2,574,726 | 11/1951 | Best | 292/359 |
| 2,978,267 | 4/1961 | North et al. | 292/359 X |
| 3,596,954 | 8/1971 | Hull | 292/128 |

*Primary Examiner*—J. Franklin Foss
*Attorney, Agent, or Firm*—Fulwider, Patton, Rieber, Lee & Utecht

[57] ABSTRACT

A locking device for use with a combined handle and rotary latch assembly having a latching hook mounted on an axle stud that is journaled for rotation, in a latch assembly, comprising a locking slide disposed alongside the stud and having a keyhole recess receiving an elongated tab on the end of the axle stud, the recess having a narrow channel portion which slides over the tab in close fitting relation to lock the latch, and having an enlarged circular portion in which the tab can rotate without restriction, to unlock the latch. Yieldable detents restrict motion of the slide from locked to unlocked positions. In one embodiment, the slide is a one-piece molding with a shaped locking recess inside an operating knob, and in another embodiment, a separately formed nylon insert is fitted in the body of the slide to form the locking parts.

7 Claims, 12 Drawing Figures

Fig. 1
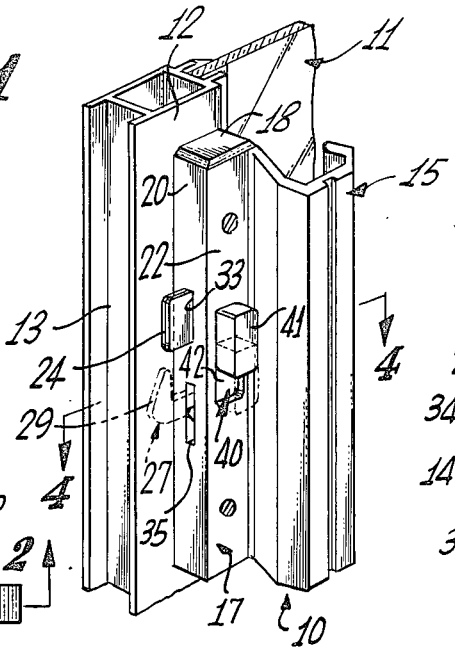
Fig. 2
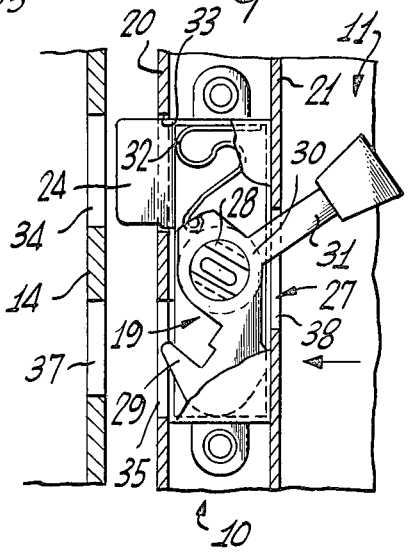
Fig. 4
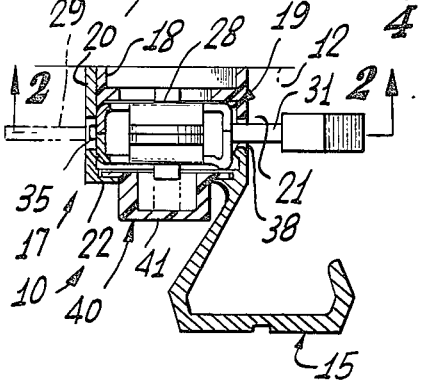
Fig. 3
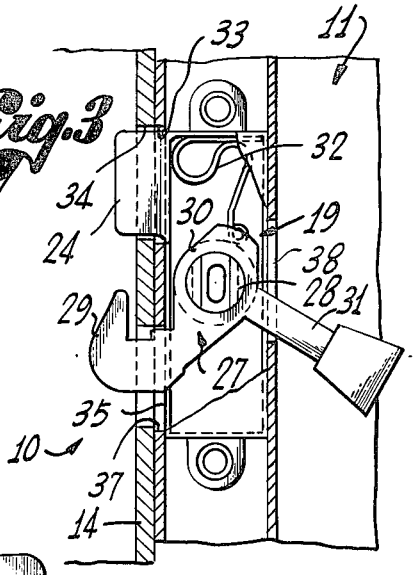
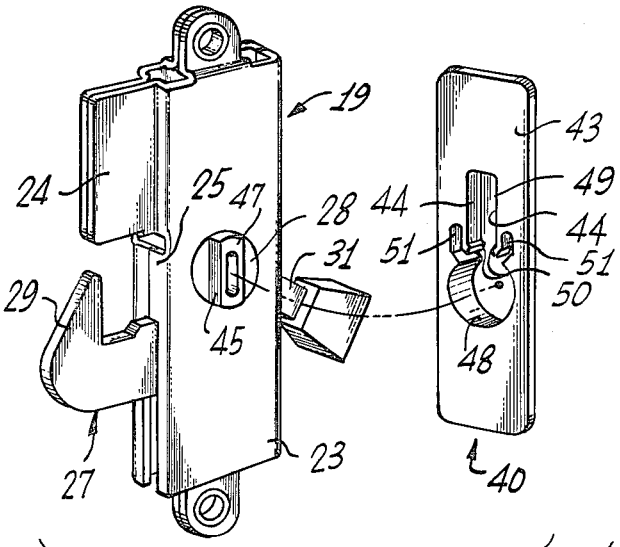
Fig. 5
Fig. 6
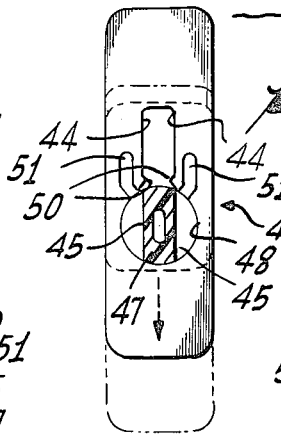
Fig. 7
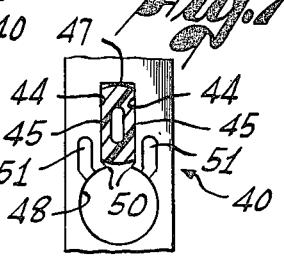
Fig. 8
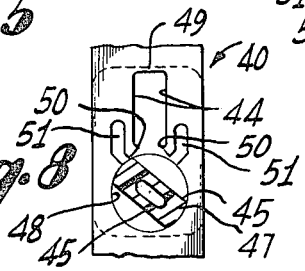

ROTARY LATCH MECHANISM WITH LOCKING DEVICE

BACKGROUND OF THE INVENTION

This invention relates to latching mechanisms and relates more specifically to a latching mechanism having a rotary latch that is manually movable between latched and unlatched positions.

One such latching mechanism is shown in U.S. Pat. No. 3,596,954, wherein a latch is rotatably mounted by means of a stud or axle in an elongated housing constituting the base of a handle for a sliding door, and is formed with a latching hook on one end and an operating handle on the other. When the handle is rocked in one direction, the latch hook is extended through a slot in the front wall of the housing for latching engagement with a keeper on the door frame. The latch is held in this position by a spring, until the handle is rocked in the opposite direction, disengaging the latch hook from the keeper and retracting it into the housing.

For increased security against forced entry, the unit in the aforesaid patent also has a holddown finger, or anti-liftout key, extending through a second slot in the front wall of the housing for insertion in a corresponding slot in the keeper. When so inserted, the holddown finger prevents lifting of the door which otherwise might allow the latch hook to be pressed out of the latched position.

It sometimes is possible, however, to force such a latch open by inserting a tool between the door and the door frame and pressing the latch hook back against the spring action. The primary objective of the present invention is to incorporate in a latching mechanism of the foregoing general character a relatively simple and inexpensive locking device that substantially increases the security achieved with such a latch.

SUMMARY OF THE INVENTION

Briefly, and in general terms, the present invention resides in a locking device that is mounted on the latch housing beside the rotary latch, for back and forth manual movement between locked and unlocked positions, and is formed with an operating knob that is accessible from outside the housing and with locking abutments that move into and out of engagement with cooperating abutments on the latch as an incident to such back and forth movement. The locking device is detented against inadvertent movement between the locked and unlocked positions, and is quite effective to increase the security of the associated closure member, yet is very simple in construction and can be incorporated in a handle assembly of the type in the aforesaid patent with a slight amount of change in the handle assembly.

More specifically, and as illustrated in the presently preferred embodiments shown herein, the locking device comprises a slide that is mounted on the housing alongside the latch for reciprocation in overlying relation with the stud that supports the latch for rotation, the locking abutments on the slide being formed in a recess in the side of the slide adjacent the latch. The cooperating abutments on the latch are on one end portion of the latch stud, which projects into the recess and has flats on its sides, which are engaged by the slide abutments when the slide is in the locked position, and are thereby held against rotation. When the slide is in the unlocked position, the slide abutments are spaced from the stud, which thus is free to rotate, and to allow the latch to rotate.

The recess preferably is keyhole-shaped, having a relatively narrow channel that extends longitudinally of the path of reciprocation of the slide, and a relatively large clearance position, preferably circular, into one side of which the channel opens. The end portion of the stud that projects into the recess is flattened on two sides, in effect forming a generally rectangular tab extending diametrically across the end of the stud within the recess. This tab is sized to fit closely between the sidewalls of the channel when the tab is parallel to these sidewalls, thus being held against rotation. In any other angular orientation of the tab, however, it cannot enter the channel. The clearance portion of the recess is at least as large in diameter as the length of the tab, so the latter can rotate freely when the slide is in the unlocked position, and the tab is in the clearance portion.

To prevent inadvertent movement of the slide between the locked and unlocked positions, spring-loaded detent means are provided on the slide at the juncture of the channel and the clearance portion, to yieldably block movement of the tab in either direction through this juncture. Preferably, one such detent is provided on each side of the channel, and the two are normally more closely spaced than the width of the tab, but are movable apart to permit passage of the tab.

Important aspects of the invention are the very simple and inexpensive construction of the locking slide, and the simplicity of its mounting on a latch housing. To these ends, the slide may be a one-piece plastic molding comprising a flat and thin base plate with an integral box-like projection on one side forming the operating knob, and with the recess in the other side of the plate extending into the box-like projection, the detents being integral parts of the molding. Mounting is accomplished simply by forming a slot in the housing wall beside the latch, sized to receive the knob and serve as a guide for the reciprocation of the slide, with the base plate disposed inside the housing and sliding along the inner side of the slotted wall.

Preferably, this inner side is grooved to receive and guide the base plate.

For increased durability, the latching device may be made in two pieces, one composed of any suitable material and forming the body of the slide, with a generally rectangular hollow. The second piece is an insert, composed of strong and durable material such as nylon, that is fitted into the body and shaped to provide the locking channel, clearance portion, and yieldable detents.

Other aspects and advantages of the invention will become apparent from the following detailed description, taken in conjunction with the accompanying drawings.

BRIEF DESCRIPTION OF THE DRAWINGS

FIG. 1 is a fragmentary perspective view of a combined handle, latch and locking assembly embodying the novel features of the present invention, shown on part of a representative sliding door;

FIG. 2 is an enlarged fragmentary cross-sectional view taken in a vertical plane through the handle assembly of FIG. 1, generally along line 2—2 of FIG. 4, and showing the representative door about to engage a representative door frame;

FIG. 3 is a further enlarged view similar to FIG. 2 but showing the door in engagement with the frame and the latch in its latched comdition;

FIG. 4 is an enlarged fragmentary cross-sectional view taken along line 4—4 of FIG. 1;

FIG. 5 is an enlarged exploded perspective view of the latch assembly and the locking slide;

FIG. 6 is a side elevational view of the inner side of the locking slide, with the adjacent end portion of the latch stud shown in cross-section, the unlocked position of the slide being shown in full and the position in broken lines;

FIG. 7 is a fragmentary view similar to part of FIG. 6, but showing the condition of the parts in the locked position of the slide and the latched position of the latch;

FIG. 8 is a view similar to FIG. 7 showing the condition of the parts in the unlocked and unlatched positions;

DETAILED DESCRIPTION OF THE FIRST EMBODIMENT (FIGS. 1-8)

Figure 10:
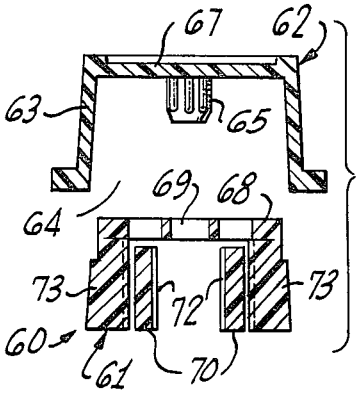
FIG. 10 is an enlarged cross-sectional view taken along line 10—10 of FIG. 9.

As shown in the drawings for purposes of illustration, the invention is embodied in a combined handle, latch and lock assembly, indicated generally by the reference number 10, for a sliding closure such as a patio door 11 (FIGS. 1, 2 and 3). The handle assembly is mounted on the stile 12 of the door, adjacent one edge 13 thereof, for engagement with a keeper 14 which herein is in the form of a slotted plate on the side of the door opening toward which the door slides in its closing movement.

The illustrative handle assembly 10 is of the same basic type shown in the aforesaid patent, comprising generally an elongated extrusion which forms a handle 15 and an integral, open-sides channel 17; an elongated hollow base 18, preferably composed of plastic, mounted in the channel 17; and a latch assembly 19 that is nested in a recess in the base 18, and disposed between the sidewalls 20 and 21 of the channel, beneath the top wall 22 thereof, so that the base and the channel cooperate to form the housing for the latch assembly 19. The latch assembly is mounted in a case 23 that has an anti-liftout key 24 on one of its side edge surfaces 25, and a rotary latch member 27 is mounted in the case on a stub or axle 28 that is journaled in the case.

The latch member 27 has a latching hook 29 at one end, a central portion 30 that is fastened to the axle stud 28, and a handle 31 that projects generally radially from the axle stud and generally in the opposite direction from the hook 29. The latter is aligned with a slot in the side edge surface 25 of the case, and the handle 31 projects out of the case through a similar slot in the opposite side surface, so as to be swingable between latching and unlatching positions, to extend and retract the hook. A spring 32 (FIGS. 2 and 3) in the case 23 urges the latch member 27 toward its latched and unlatched positions, with a reversing over-center action.

When the latch assembly 19 is in place in the handle assembly 10, the anti-liftout key 24 projects out of the channel 17 through a slot 33 in the front sidewall 20 thereof, for insertion in a slot 34 in the keeper 14, and the latch hook 29 is aligned with a second slot 35 in the front sidewall 20, for latching engagement in a second slot 37 in the keeper 14. The latch handle 31 projects through a slot 38 in the rear sidewall 21 of the channel, so as to be accessible behind the handle 15 for operation of the latch assembly.

The foregoing aspects of the handle assembly 10 are in accordance with the aforesaid patent, to which reference is made for further details of construction and use. The present invention is concerned with an improved and simplified locking device 40 for use with a rotary latch member of the general type included in such a handle assembly, to increase the degree of security against forced entry from the outside, this improvement being particularly well suited for handle assemblies of the type in the aforesaid patent.

As has been noted, it is possible to force the latch member 27 from the latched position to the unlatched position by inserting a thin rod between the door and the door jamb and pressing the extended hook 29 downwardly and back into the case 23. The locking device 40 of the present invention is incorporated in the handle assembly 10 in a position that is inaccessible to such a tool, and is manually movable between locked and unlocked positions, effectively holding the latch against such forced movement when in the locked position.

As shown most clearly in FIGS. 1, 4 and 5, the locking device is a slide 40 that is mounted between the latch assembly 19 and the top housing wall 22 for reciprocation between locked and unlocked positions, and has an operating knob 41 that projects through an elongated slot 42 (FIG. 1) in the top wall, for convenient access from the inside of the door. The slide has an inner side 43 (FIG. 5) that overlies one side of the latch assembly, and carried on this inner side are locking abutments 44 which move into and out of engagement with opposed locking abutments 45 on the latch assembly 19 as the slide is moved into and out of the locked position. When engaged, the two sets of abutments 44 and 45 cooperate to hold the latch member 27 against rotation out of the latched position.

Herein, the abutments 45 on the latch assembly 19 are on one end portion of the stud 28, which projects beyond the side of the casing 23 and has flattened sides, in effect forming a relatively narrow rib or tab 47 that extends diametrically across the end of the stud. The abutment 44 on the slide are the opposite sidewalls of a recess in the side of the slide adjacent the latch assembly, opening at one end into a larger clearance space in which the tab 47 can rotate unobstructedly. For reversibility of the latching assembly, the tab 47 is formed on each end of the axle stud 28.

In the first embodiment shown herein, the slide 40 in a one-piece plastic molding in which the locking recess is formed within the operating knob and is keyhole-shaped, having an enlarged clearance portion 48 of circular cross-section at one end, and a narrower channel-shaped portion 49 extending away from one side of the recess, longitudinally of the path of reciprocation of the slide and centered on the axis of rotation of the axle stud 28. The width of the channel-shaped portion 49 is only slightly greater than the width of the tab 47, to receive the latter with a close fit, and the diameter of the clearance portion 48 is at least as great as the length of the tab, to permit the tab to rotate in this portion.

To prevent inadvertent movement of the slide into the locked position, and also to prevent displacement from the locked position, either inadvertently or by shaking of the door, detents 50 are provided at the juncture of the channel and clearance portions 49 and 48 to yieldably resist movement of the tab 47 through this juncture in both directions. As can be seen in FIGS. 5 through 8, these detents are small ridges at the ends of the sidewalls 44, reducing the width of the channel to less than the width of the tab 47. Grooves 51 are formed in the wall of the slide outside these detent ridges, so that the ridges are supported on elongated and resiliently flexible fingers of the plastic material. Thus, the fingers will flex and permit the ridges to spread outwardly as the tab is moved in either direction.

Various relative positions of the slide 40 and the tab 47 are shown in FIGS. 6, 7 and 8. In the normal unlocked and unlatched condition of the latch member, as shown in FIG. 2, the parts are positioned as shown in FIG. 8, wherein it will be seen that the tab 47 is angularly misaligned with the channel-shaped portion 49 of the recess, and thus blocks movement of the slide 40 to the locked position. When the latch member is moved to the latched condition (FIG. 3), the tab 47 is turned to the position shown in FIG. 6, in alignment with the channel-shaped portion 49 of the recess. Thus the slide 40 can be shifted to the locked position, and this moves the parts to the condition shown in FIG. 7.

It will be evident that the tab 47 is effectively held against turning in this condition, and the stud 28 and the latch member 27 are similarly held. As a result, the latch assembly 19 is effectively locked against being forced by a tool inserted between the edge of the door and the frame.

The slot 42 (FIG. 1) through which the operating knob 41 projects is sufficiently longer than the knob to permit it to move between the two positions of the slide 40 illustrated in FIGS. 6 and 7, also indicated in broken lines in FIGS. 1 and 6. The sidewalls of the slot bear against the sides of the operating knob and thus serve as guides, while the ends of the slot serve as stops for the slide. The remainder of the slide can be merely a thin and flat base plate, which rides along the inner side of the wall 22 and against the adjacent side of the latch case 23. It should be noted that the sidewalls of the slot 42 also are positioned to back up and reinforce the slide, immediately beyond the plane of the base plate, in the event that excessive turning force is applied to the tab 47 while it is within the channel-shaped portion 49 of the locking recess.

DESCRIPTION OF THE SECOND EMBODIMENT (FIGS. 9–12)

Figure 9:
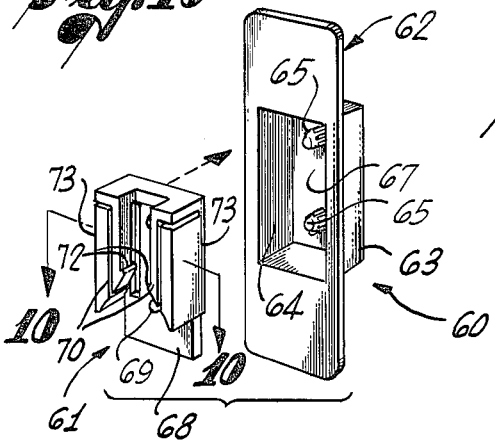
FIG. 9 is an exploded perspective view of an alternative embodiment of the locking slide.

Shown in FIGS. 9 through 12 is an alternative embodiment of the locking slide, indicated generally by the reference number 60 in FIGS. 9 and 10, in which the locking recess is defined by a separately molded insert 61 that is fitted into the body 62 of the slide. This embodiment, which is the presently preferred embodiment, permits the use of a material such as nylon for the operative elements of the slide, while the body may be of a different plastic. In addition, improved spring action is provided for the detents.

As shown in FIGS. 9 and 10, the body 62, as before, comprises a generally rectangular base plate with a box-like projection 63 on one side forming an operating knob. The recess 64 in the knob, however, is simply a generally rectangular hollow, with two knurled studs 65 integrally formed on the inside of the top wall 67.

The insert 61 has a base wall 68 that fits against the top wall 67 of the body 62, with two holes 69 which receive the studs 65 with a force fit, thereby anchoring the insert in the body. The channel-shaped locking portion is formed by two elongated fingers 70, each of which is integrally joined at one end to an upstanding flange 71 at one end of the base wall, the right end of FIG. 11, and extends cantilever-fashion to the left along the base wall. Ridges 72 adjacent the free ends of the fingers form the detents.

Figure 11:
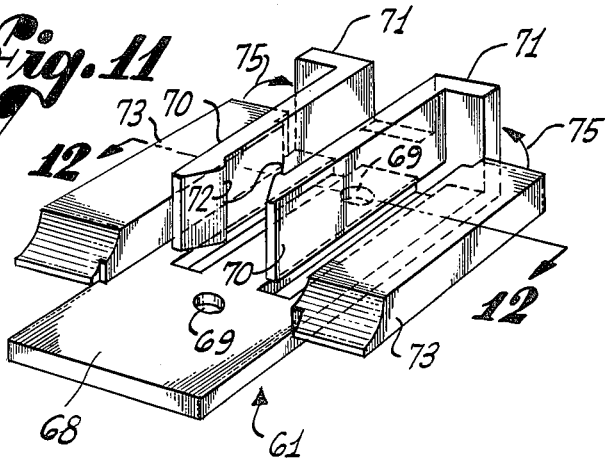
FIG. 11 is a further enlarged perspective view of the insert of the locking slide, showing the positions of its parts as they are molded.
Figure 12:
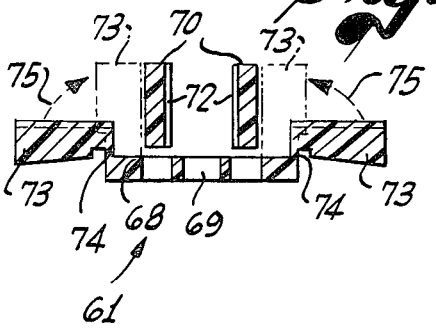
FIG. 12 is a cross-sectional view taken along line 12—12 of FIG. 11.

To back up these fingers, which are flexible along their full length, two blocks 73 of plastic are integrally joined to the base wall 68 along side edges thereof, initially being molded in the position shown in FIGS. 11 and 12. Thin and flexible webs 74 (FIG. 12) of plastic join the blocks to the base wall, and form hinges permitting the blocks to be swung ninety degrees, as indicated by the arrow 75 in FIGS. 11 and 12, into positions normal to the plane of the base wall, shown in broken lines in FIG. 12 and in full lines in FIGS. 9 and 10.

With the blocks 73 in these positions, the insert 61 is fitted in the body 62, and thereafter is functionally an integral part of the slide. The blocks abut against the sidewalls of the recess 64, and are spaced preselected distances from the fingers 70, to permit a limited amount of flexible thereof as the slide is moved into the out of the locked position.

From the foregoing, it will be evident that the present invention provides a novel, simple and effective locking device for a rotary latch, and is particularly well suited for incorporation in a handle assembly of the type in the aforesaid patent. It also will be evident that, while two specific embodiments have been illustrated and described, various modifications and changes may be made within the spirit and scope of the invention.

We claim:

1. In a combined handle, latch and locking assembly including an elongated handle, a mounting channel joined to said handle for attachment to a sliding closure, a latch assembly including a rotary latch member secured to an axle stud and supported by said stud for movement between latched and unlatched positions, and means mounted said latch assembly in said mounting channel beneath a top wall thereof, for extension and retraction of said latch member therefrom, an improved locking device comprising:

a locking slide comprising a generally rectangular, thin and flat base plate, and a box-like projection on one side of said base plate forming an operating knob for the locking device, said slide having a recess opening through the other side and extending into said projection;

means defining a slot in said cover wall overlying said latch assembly and sized to receive said projection with a sliding fit, said slot being substantially longer than the projection to permit the latch to reciprocate in said slot along a predetermined path between locked and unlocked positions, said base plate being disposed between said top wall and said latching assembly, and said projection extending away from said latch assembly through said slot;

an elongated tab on the end of said stud adjacent said slide extending diametrically across the stud and projecting into said recess, said tab having flat sides spaced a preselected distance apart and being centered on the axis of said stud;

means in said recess defining an elongated channel parallel to said path and having sidewalls spaced and positioned to receive said tab with a close fit when the latter is parallel to said path, thereby to prevent rotation of said tab, said stud and said latch member, said tab being positioned on said stud to be parallel to said path when said latch member is in the latched position;

said recess also having an enlarged clearance portion at one end of said channel, large enough to permit said stud to rotate unobstructed therein;

said tab being disposed in said clearance portion when said slide is in said unlocked position, and in said channel when said slide is in said locked position;

and detent ridges on the sidewalls of said channel at the juncture of said clearance portion and said channel for yieldably resisting passage of said tab, thereby to hold the slide releasably in the locked and unlocked positions.

2. A combined handle, latch and locking assembly as defined in claim 1 in which said slide, said box-like projection, said means defining said channel, and said detent means comprise a one-piece plastic molding, said recess being shaped to define said channel and said clearance portion as a keyhole-shaped recess.

3. A combined handle, latch and locking assembly as defined in claim 1 further including means defining yieldable spring fingers along said side wall, supporting said detent ridges.

4. A combined handle, latch and locking assembly as defined in claim 1 in which said slide and said projection are an integral molding forming a body for the locking device, said channel and said detent ridges being formed on a separate insert anchored in said body.

5. A combined handle, latch and locking assembly as defined in claim 4 which said insert comprises a second base plate secured in said recess, elongated spring fingers each integrally joined at one end to said second base plate and spaced apart to define said channel, said fingers having said detent ridges adjacent free ends thereof, and blocks integrally joined to said second base plate and positioned along said spring fingers to limit flexing thereof.

6. A combined handle, latch and locking assembly as defined in claim 5 in which said blocks are joined to said base plate by thin and flexible hinge webs, and are disposed at approximately ninety-degree angles with said base plate, in abutment with sidewalls of said recess and in spaced relation with said fingers.

7. In a latching mechanism including a latching assembly comprising a latch member, an axle stud affixed to said latch member and supported for rotation in said assembly to rotate said latch member between angularly spaced preselected latched and unlatched positions, and supporting means for said latch assembly including a wall extending along one side of the latter adjacent one end of said axle stud, the combination of:

a locking slide mounted between said wall and said one side, and supported for back and forth reciprocation past said one end along a preselected path and between locked and unlocked positions, said slide having first locking abutment means and clearance means thereon, each moveable into and out of overlying relation with said one end as said slide moves between said locked and unlocked positions, respectively;

and second locking abutment means on said one end of said axle stud for locking engagement with said first locking abutment means when said slide is in said locked position and said latch member is in said latched position;

said second locking abutment means comprising an elongated tab extending across said one end of said axle stud and rotatable therewith and with said latch member, said first locking abutment means comprising two spaced side walls defining a channel in said slide and spaced to receive said axle stud between them with a close fit to block rotation of said axle stud, and said clearance means comprising a clearance space at one end of said slide to permit rotation of said tab and said axle stud when the slide is in said unlocked position;

said first and second locking abutment means being operable, when engaged, to block rotation of said axle stud and thereby lock said latch member in said latched position, and said axle being permitted to rotate when said first and second locking abutment means are disengaged and said clearance means overlies said one end;

an operating knob on said locking projecting through said wall for manual operation of said locking slide;

and yieldable detent ridges at the juncture of said first locking abutment means and said clearance means, adjacent said one end, yieldably resisting movement of said locking slide between said locked and unlocked positions.

* * * * *

UNITED STATES PATENT AND TRADEMARK OFFICE

CERTIFICATE OF CORRECTION

PATENT NO. : 4,068,874

DATED : January 17, 1978

INVENTOR(S) : Paul D. Fleming; Kenneth N. Gullekson

It is certified that error appears in the above-identified patent and that said Letters Patent are hereby corrected as shown below:

Column 2, line 6, change "position" to --portion--

Column 3, line 8, insert --locked-- before "position"

Column 3, line 50, change "stub" to --stud--

Column 4, line 52, change "in" (second occurrence) to --is--

Column 6, line 23, change "flexible" to --flexing-- line 23, change "the" (second occurrence) to --and-- line 40, change "mounted" to --mounting-- line 53, change "latch" to --latter--

Column 7, line 32, insert --in-- before "which"

Column 8, line 36, after "axle" insert --stud-- line 40, after "locking" insert --slide--

Signed and Sealed this

*Sixteenth* Day of *May 1978*

[SEAL]

*Attest:*

RUTH C. MASON
*Attesting Officer*

LUTRELLE F. PARKER
*Acting Commissioner of Patents and Trademarks*